US007007649B2

(12) United States Patent
Raghavan et al.

(10) Patent No.: US 7,007,649 B2
(45) **Date of Patent: *Mar. 7, 2006**

(54) ENGINE VALVE ACTUATOR ASSEMBLY

(75) Inventors: Madhusudan Raghavan, West Bloomfield, MI (US); Jie Tong, Sterling Heights, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/771,279

(22) Filed: Feb. 3, 2004

(65) Prior Publication Data

US 2004/0194747 A1 Oct. 7, 2004

Related U.S. Application Data

(63) Continuation-in-part of application No. 10/392,292, filed on Mar. 18, 2003, now abandoned.

(51) Int. Cl.
*F01L 1/18* (2006.01)

(52) U.S. Cl. ..... 123/90.39; 123/90.16; 123/90.44

(58) Field of Classification Search ..... 123/90.16, 123/90.39, 90.44, 90.6
See application file for complete search history.

(56) References Cited

U.S. PATENT DOCUMENTS

| | | | | |
|---|---|---|---|---|
| 4,459,946 | A | 7/1984 | Burandt | 123/90.16 |
| 4,836,155 | A | 6/1989 | Stagley et al. | 123/90.16 |
| 5,176,581 | A * | 1/1993 | Kumm | 474/110 |
| 5,373,818 | A | 12/1994 | Unger | 123/90.16 |
| 5,619,958 | A | 4/1997 | Hampton et al. | 123/90.16 |
| 5,642,692 | A * | 7/1997 | Wride | 123/90.16 |
| 6,058,895 | A | 5/2000 | Hermsen | 123/90.16 |
| 6,085,705 | A * | 7/2000 | Vorih | 123/90.12 |
| 6,112,711 | A | 9/2000 | Shimizu et al. | 123/90.16 |
| 6,666,178 | B1 * | 12/2003 | Keller et al. | 123/90.12 |
| 6,688,267 | B1 * | 2/2004 | Raghavan | 123/90.16 |

* cited by examiner

*Primary Examiner*—Thomas Denion
*Assistant Examiner*—Ching Chang
(74) *Attorney, Agent, or Firm*—Kathryn A. Marra

(57) ABSTRACT

A valve actuator assembly for an engine includes a movable engine valve. The valve actuator assembly also includes a movable roller finger follower operatively engaged with the engine valve, a rotatable cam, and an intermediate finger follower operatively engaged with the roller finger follower and the cam. The valve actuator assembly also includes at least one actuator operatively cooperating with the intermediate finger follower to position the intermediate finger follower in two directions relative to the cam to move the roller finger follower to position the engine valve at a desired lift and phasing.

28 Claims, 3 Drawing Sheets

ENGINE VALVE ACTUATOR ASSEMBLY

CROSS REFERENCE TO RELATED APPLICATION

This application is a continuation-in-part of U.S. patent application Ser. No. 10/392,292, filed Mar. 18, 2003, now abandoned which is hereby incorporated by reference in its entirety.

TECHNICAL FIELD

The present invention relates generally to intake or exhaust valve actuators for engines and, more particularly, to a valve actuator assembly for continuously variable lift, phasing, and cylinder deactivation for an internal combustion engine.

BACKGROUND OF THE INVENTION

It is known to provide a valve train or valve actuator assembly for an engine such as an internal combustion engine of a vehicle such as a motor vehicle. Typically, the valve train includes one or more valves, a cam shaft having one or more cams, and a tappet contacting each cam and valve. Typically, engine valve actuation is accomplished via the engine-driven camshaft.

It is also known to provide a valve train for an internal combustion engine having a valve with an adjustable stroke or variable lift. In this patent, the adjustment of the stroke or lift of the valve takes place by an eccentric shaft, which displaces the supporting point of a transfer element disposed between each cam and each intake/exhaust valve, in which case the two eccentrics assigned to one cylinder are of a different geometry. The transfer element is formed by a valve lever, which is supported on the eccentric and is actuated by the cam, which valve lever, in turn, acts upon a rocker lever.

One disadvantage of some of these valve trains is that desired phasing is achieved via a camshaft phaser, which is unacceptable for high compression combustion systems, wherein each valve must be capable of having its own specifiable lift and phase setting. Another disadvantage of some of these valve trains is that they do not provide continuously variable valve lift, phasing, and cylinder deactivation. A further disadvantage of some of these valve trains is that they have only one degree-of-freedom control, coupling the lift and phase of the engine valve, and therefore they require an additional phaser for the camshaft.

As a result, it is desirable to provide a valve actuator assembly for an engine that improves valve lift, phasing, and cylinder deactivation. It is also desirable to provide a valve actuator assembly for an engine having more than one degree-of-freedom to allow decoupling of lift and phasing for an engine valve. It is further desirable to provide a valve actuator assembly for an engine that eliminates the use of a phaser for desired phasing of an engine valve. Therefore, there is a need in the art to provide a valve actuator assembly for an engine that meets these desires.

SUMMARY OF THE INVENTION

It is, therefore, one object of the present invention to provide a new valve actuator assembly for an engine.

It is another object of the present invention to provide a valve actuator assembly for an engine that has continuously variable valve lift, phasing, and cylinder deactivation.

To achieve the foregoing objects, the present invention is a valve actuator assembly for an engine. The valve actuator assembly includes a movable engine valve. The valve actuator assembly also includes a movable roller finger follower operatively engaged with the engine valve, a rotatable cam, and an intermediate finger follower operatively engaged with the roller finger follower and the cam. The valve actuator assembly also includes at least one actuator operatively cooperating with the intermediate finger follower to position the intermediate finger follower in two directions relative to the cam to move the roller finger follower to position the engine valve at a desired lift and phasing.

The intermediate finger follower may be operatively engaged with the cam and the roller finger follower by direct physical contact, or via first and second rollers. If rollers are used, then a stationary curved ramp is provided to guide movement of the second roller as it is engaged with the intermediate finger follower and the roller finger follower. The continuous operative connection between the cam, the intermediate finger follower and the roller finger follower is achieved by springs biasing the roller finger follower of the second roller.

One advantage of the present invention is that a valve actuator assembly is provided for an engine for continuously variable valve lift, phasing, and cylinder deactivation. Another advantage of the present invention is that the valve actuator assembly has increased functionality, i.e., independent control of valve lift and phase for each individual engine valve. Yet another advantage of the present invention is that the valve actuator assembly has precision and repeatability and does not suffer from temperature dependent fluid characteristics of hydraulic systems. Still a further advantage of the present invention is that the valve actuator assembly has two degrees-of-freedom control of an intermediate lever pivot that allows decoupling of lift and phasing for an engine valve. A further advantage of the present invention is that the valve actuator assembly allows individual valve control for a high compression engine. Yet a further advantage of the present invention is that the valve actuator assembly has cam-based actuation that enables precise operation.

Another advantage of the invention is that continuous contact is maintained between the moving parts, so noise is minimized.

Other objects, features, and advantages of the present invention will be readily appreciated, as the same becomes better understood, after reading the subsequent description taken in conjunction with the accompanying drawings.

The above features and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
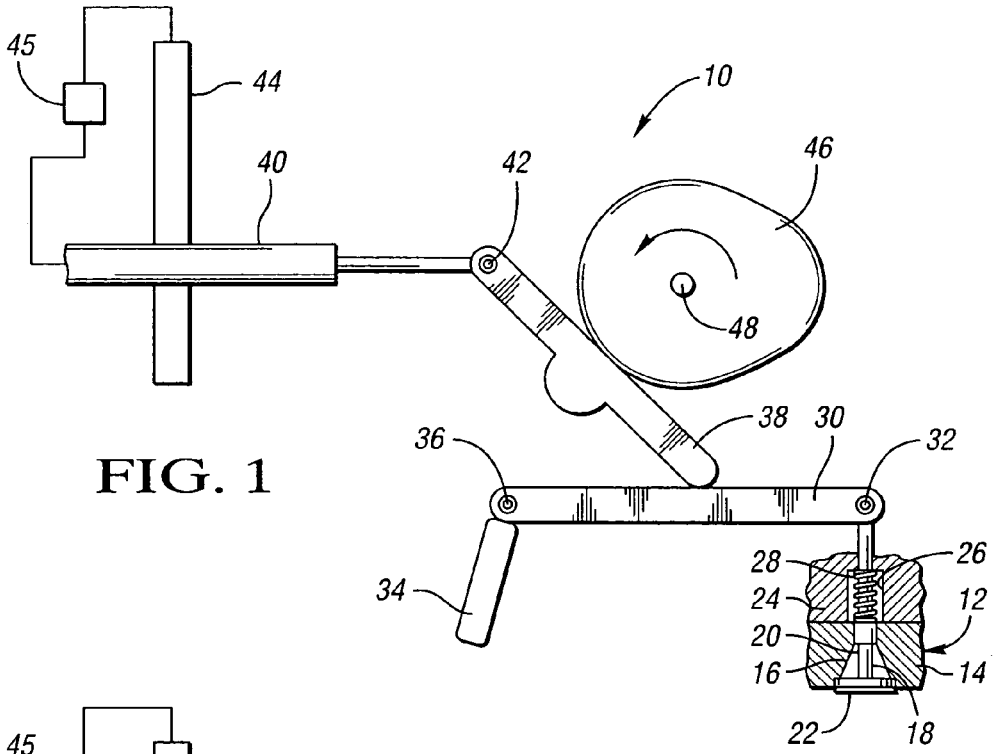
FIG. 1 is a diagrammatic view of a valve actuator assembly, according to the present invention, illustrated in operational relationship with an engine.

Referring to the drawings and in particular FIG. 1, one embodiment of a valve actuator assembly 10, according to the present invention, is shown for an engine, generally indicated at 12, of a vehicle (not shown). The engine 12 is of an internal combustion type. The engine 12 includes an engine block 14 having at least one opening 16 therein in communication with at least one internal combustion chamber (not shown). The engine 12 also includes a movable engine valve 18 for each opening 16. The engine valve 18 has a valve stem 20 and a valve head 22 at one end of the valve stem 20. The engine valve 18 is movable to open and close its respective opening 16 between an open position and a closed position. It should be appreciated that the engine valve 18 may be either an intake or exhaust valve. It should also be appreciated that the valve actuator assembly 10 is a valve train for the engine 12. It should further be appreciated that, except for the valve actuator assembly 10, the engine 12 is conventional and known in the art.

The valve actuator assembly 10 includes a housing 24 disposed adjacent the engine block 14. The housing 24 has a chamber 26 therein. The valve actuator assembly 10 includes an engine valve spring 28 disposed in the chamber 26 about the valve stem 20 and contacting the engine block 14 to bias the engine valve 18 toward the closed position. It should be appreciated that the valve head 22 closes the opening 16 when the engine valve 18 is in the closed position.

The valve actuator assembly 10 also includes a roller finger follower 30 to control the position of the engine valve 18. In the embodiment illustrated, the roller finger follower 30 has one end in contact with one end of the valve stem 20 opposite the valve head 22 at a contact point 32. The valve actuator assembly 10 also includes a hydraulic lash adjuster 34 adjacent the other end of the roller finger follower 30. The lash adjuster 34 is pivotally connected to the other end of the roller finger follower 30 at an attachment point 36. It should be appreciated that the attachment point 36 is a pivot point for the roller finger follower 30.

The valve actuator assembly 10 further includes an intermediate finger follower 38 to control the position of the roller finger follower 30. In the embodiment illustrated, the intermediate finger follower 38 has one end contacting the roller finger follower 30. The valve actuator assembly 10 includes a first actuator 40 connected to one end of the intermediate finger follower 38 at an attachment point 42 to position the intermediate finger follower 38. The valve actuator assembly 10 also includes a second actuator 44 connected to the first actuator 40 to position the first actuator 40. The actuators 40 and 44 are of a linear type such as a solenoid electrically connected to a source of electrical power such as a controller 45. It should be appreciated that the second actuator 44 may be connected to one end of the intermediate finger follower 38 at the pivot point 42 to position the intermediate finger follower 38 and the first actuator 40 connected to the second actuator 44 to position the second actuator 44. It should also be appreciated that any suitable two degree-of-freedom device, such as a linear slide and rotary pivot or two rotary pivots in series, can be used to position the pivot point 42 in order to obtain a desired lift and phasing of the engine valve 18.

The valve actuator assembly 10 further includes at least one rotatable cam 46 attached to a cam shaft (not shown) for cooperating with the intermediate finger follower 38. The cam 46 has a cam center 48 that is fixed but rotatable. It should be appreciated that the inclination of the intermediate finger follower 38 provides phasing of the engine valve 18 and the distance of the intermediate finger follower 38 from the cam center 48 provides lift of the engine valve 18. It should also be appreciated that the actuators 40 and 44 may be any suitable device that generates straight-line motion. It should further be appreciated that the controller 45 energizes and de-energizes the actuators 40 and 44 to move the intermediate finger follower 38.

In operation of the valve actuator assembly 10, the engine valve 18 is shown in a closed position as illustrated in FIG. 1. The cam 46 pushes against the intermediate finger follower 38, which in turn pushes against the roller finger follower 30, thereby opening the engine valve 18. The pivot of the intermediate finger follower 38 is carried on by the actuators 40 and 44 in the horizontal (x) and vertical (y) directions. The actuators 40 and 44 enable the location of the pivot point 42 of the intermediate finger follower 38 at any point in the plane of FIG. 1. This allows independent control of lift and phasing of the engine valve 18. It should be appreciated that lift can be varied continuously from zero to a predetermined maximum lift. It should also be appreciated that phasing can also be varied continuously for any camshaft angle, preferably from minus fifteen degrees (−15°) of camshaft angle to plus fifteen degrees (+15°) of camshaft angle, at any lift setting.

Figure 2:
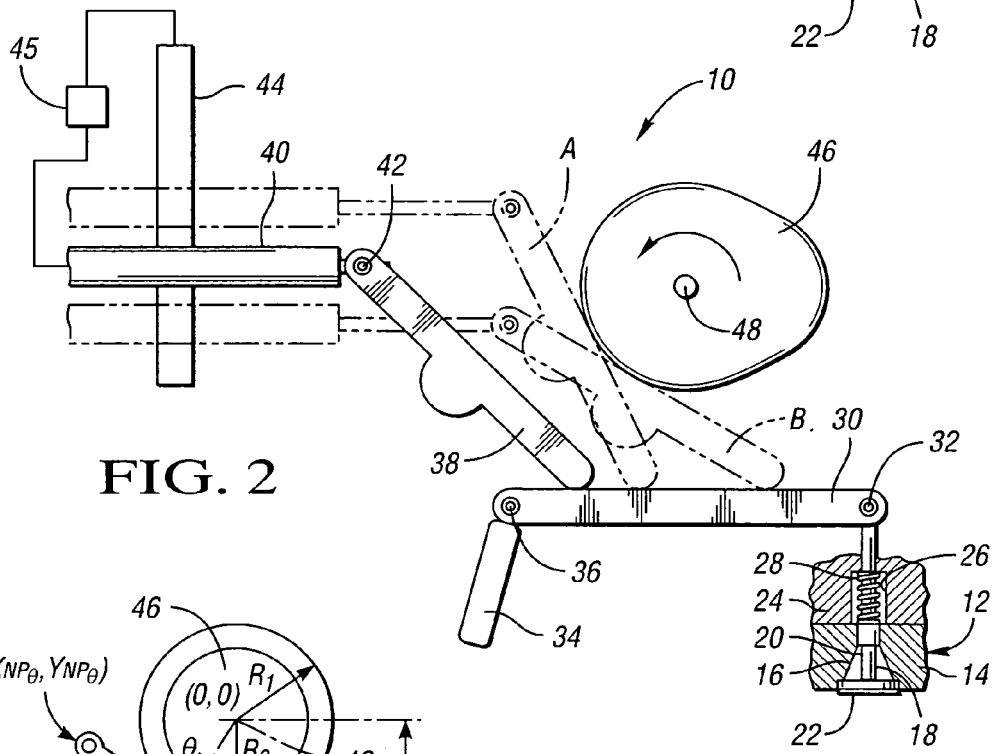
FIG. 2 is a view similar to FIG. 1 of the valve actuator assembly in various positions corresponding to different valve lift and phasing.

As illustrated in FIG. 2, the phantom lines show different positions of the intermediate finger follower 38 corresponding to different levels of lift and phasing of the engine valve 18. The intermediate finger follower 38 is illustrated in solid lines with nominal phasing. As the intermediate finger follower 38 is moved away from the cam center 48 or axis of rotation by the first actuator 40, the level of lift of the engine valve 18 decreases. The intermediate finger follower 38 is illustrated in solid lines with zero lift. Furthermore, the inclination of the intermediate finger follower 38 is correlated with valve phasing. A steep inclination of the intermediate finger follower 38 with respect to the horizontal indicates phase advance as illustrated by the phantom lines and designated as "A" in FIG. 2 and a shallow inclination of the intermediate finger follower 38 with respect to the horizontal indicates a phase retard as illustrated by the phantom lines and designated as "B" in FIG. 2.

Figure 3:
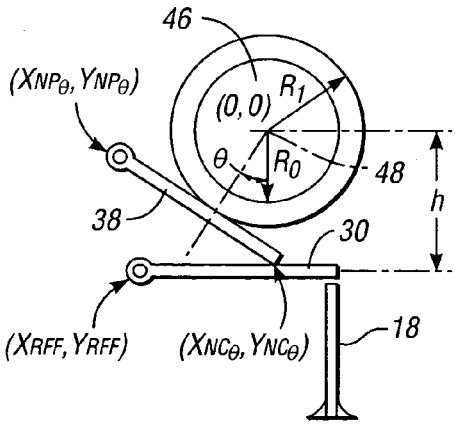
FIG. 3 is a diagrammatic view of the valve actuator assembly of FIG. 1 illustrated for computations of the location of an intermediate finger follower.

Referring to FIG. 3, computation of the pivot location or pivot point 42 for the intermediate finger follower 38 for the desired lift ($lift_{REF}$) and phasing (▯) is illustrated. The length of the intermediate finger follower 38 is $l_{IFF}$. For each desired value of lift and phase, the unique position of the intermediate finger follower 38 is computed in four steps. In step 1, compute the nominal contact point for desired phasing and zero lift as follows:

Nominal Contact Point $$^{X}NC_{\theta} = -R_1 \sin\theta + \frac{(h - R_1 \cos\theta)}{\tan\theta}$$

$$^{Y}NC_{\theta} = -h$$

In step 2, compute nominal pivot point corresponding to this contact point as follows:

Nominal Pivot Point $$x_{NP_\theta} = x_{NC_\theta} - l_{IFF} \cos\theta$$

$$y_{NP_\theta} = -h + l_{IFF} \sin\theta$$

In step 3, compute □x using the following equations:

$$\text{lift}_{RFF} = (\text{lift}_{IFF} \cos\theta) \times (\text{ratio}_{RFF})$$

$$ratio_{RFF} = \frac{l_{RFF}}{x_{NC_\theta} + \delta x - x_{RFF}}$$

$$lift_{IFF} = (\delta x \sin\theta) \times (ratio_{IFF})$$

$$ratio_{IFF} = \frac{l_{IFF}}{l_{IFF} - \frac{(h - (R_1 - \delta x \sin\theta)\cos\theta)}{\sin\theta}}$$

In step 4, compute pivot location of the intermediate finger follower 38 as follows:

$$(x_{NP}, y_{NP}) = (x_{NP\theta}, y_{NP_\theta}) + (\delta x, 0)$$

The valve actuator assembly 10 of the present invention has increased functionality, i.e. independent control of valve lift and phase for each individual valve; this means that at any given time, each valve of the engine could be at a different level of lift and phase. The valve actuator assembly 10 of the present invention improves precision and repeatability. The valve actuator assembly 10 of the present invention has an intermediate finger follower 38 that allows variable lift and phasing of the engine valve 18. The valve actuator assembly 10 of the present invention has two degrees-of-freedom control of the pivot point 42 of the intermediate finger follower 38 and this allows it to decouple lift and phasing of the engine valve 18.

Figure 4:
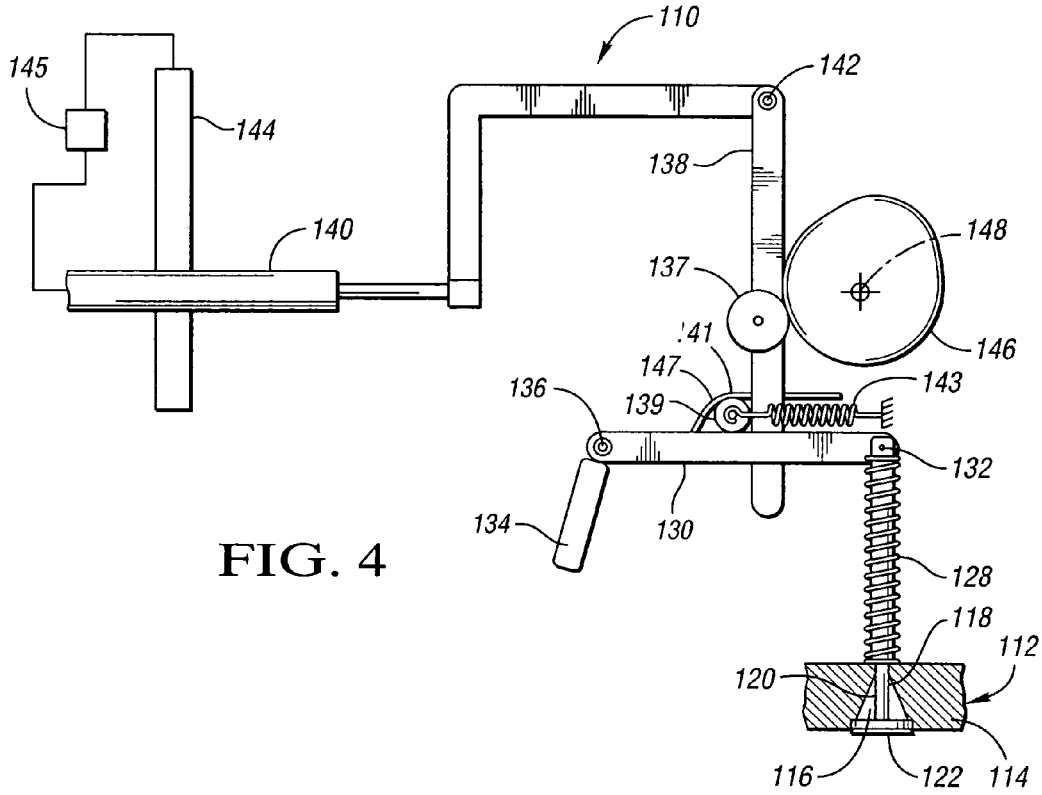
FIG. 4 is a diagrammatic view of a valve actuator assembly according to an alternative embodiment of the present invention.
Figure 5:
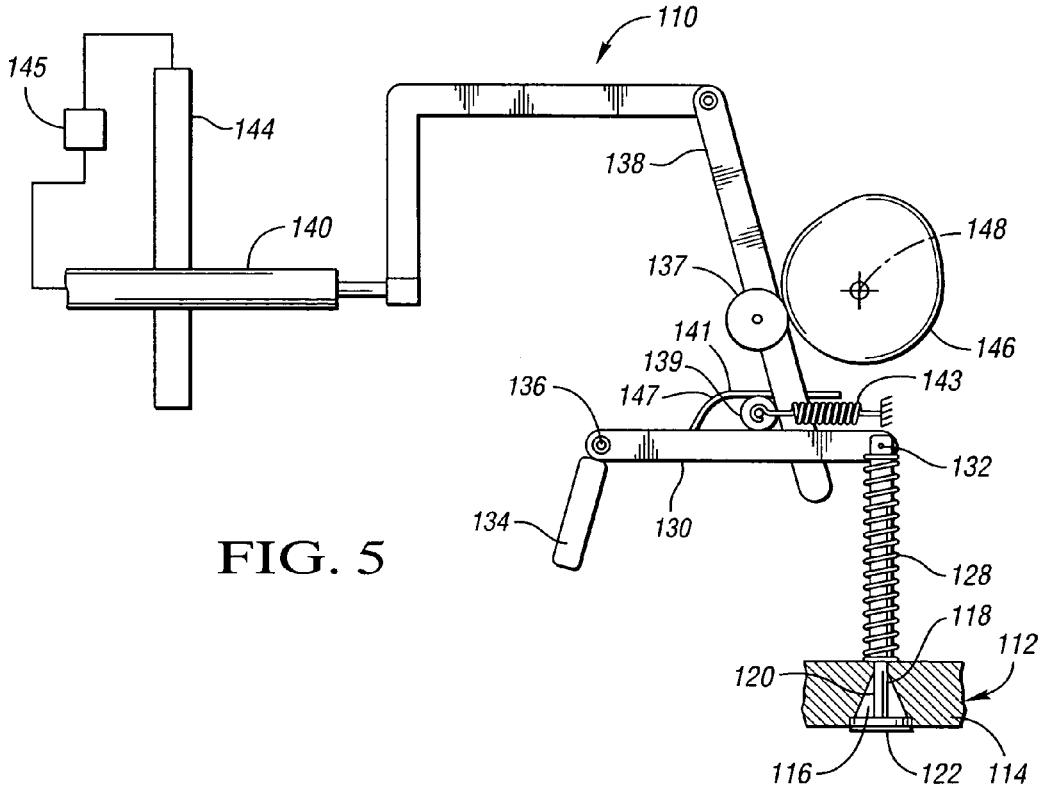
FIG. 5 is a view similar to FIG. 4 of the alternative valve actuator assembly in a different position corresponding to different valve lift and phasing.
Figure 6:
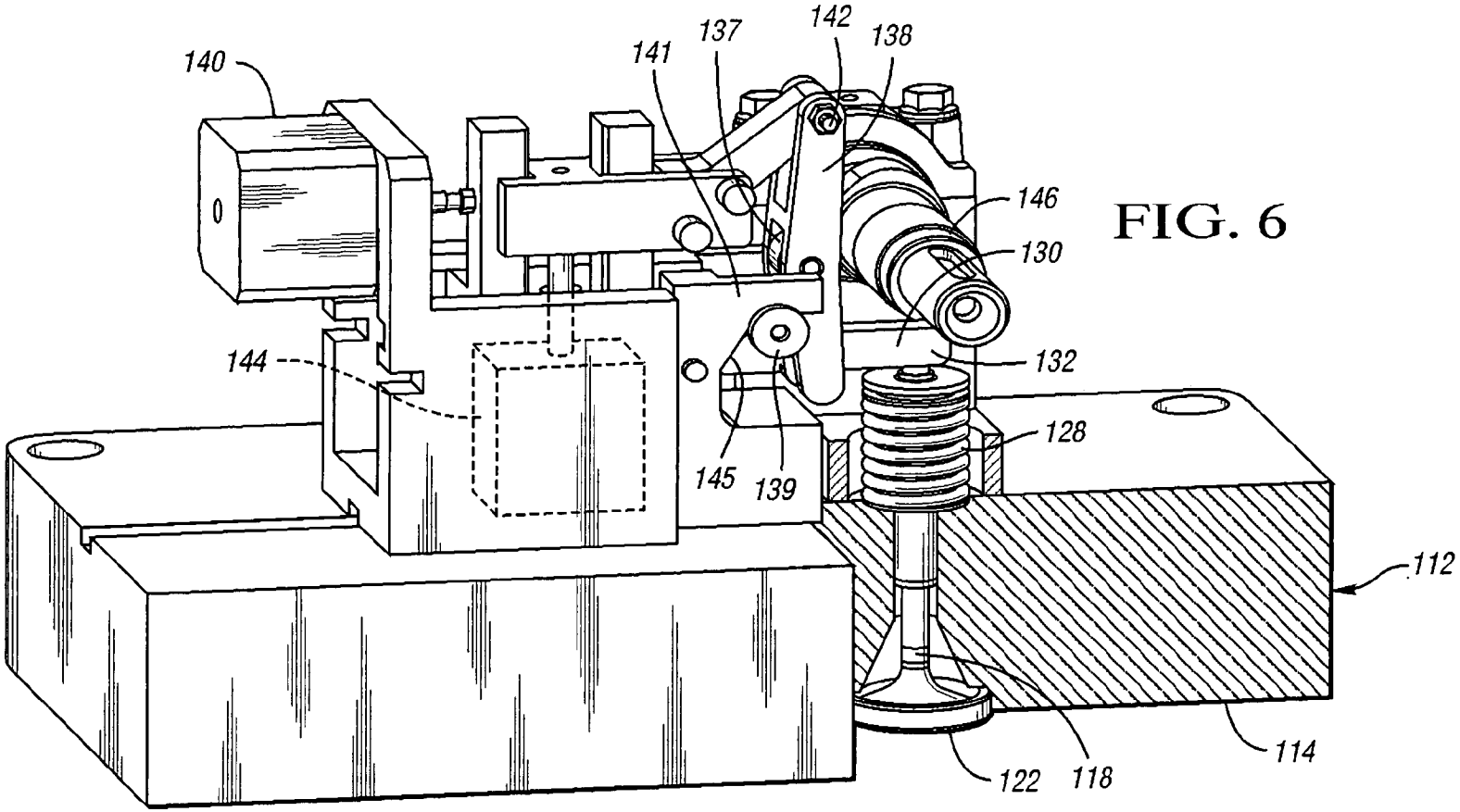
FIG. 6 is a partial perspective view of a valve actuator on an engine, corresponding with the embodiment of FIGS. 4 and 5.

An alternative embodiment of the invention is shown in FIGS. 4–6. In this embodiment, the valve actuator assembly 110 is provided on an engine 112 which includes an engine block 114 having at least one opening 116 therein in communication with at least one internal combustion chamber (not shown). The engine 112 also includes a movable engine valve 118 for each opening 116. The engine valve 118 has a valve stem 120, with a valve head 122 at one end of the valve stem 120. This structure is similar to that shown and described with respect to FIGS. 1 and 2.

The valve actuator assembly 110 includes an engine valve spring 128 disposed about the valve stem 120 and contacting the engine block 114 to bias the engine valve 118 toward the closed position.

The valve actuator assembly 110 also includes a roller finger follower 130 to control the position of the engine valve 118. The roller finger follower 130 has one end in contact with one end of the valve stem 120 opposite the valve head 122 at a contact point 132. The valve actuator assembly 110 also includes a hydraulic lash adjuster 134 adjacent the other end of the roller finger follower 130. The lash adjuster 134 is pivotally connected to the other end of the roller finger follower 130 at an attachment point 136. It should be appreciated that the attachment point 136 is a pivot point for the roller finger follower 130.

The valve actuator assembly 110 further includes an intermediate finger follower 138 which is operative to control the position of the roller finger follower 130. The first roller 137 is pinned to the intermediate finger follower 138. The intermediate finger follower 138 is operatively engaged with the cam 146 via the first roller 137.

The valve actuator assembly 110 includes a first actuator 140 operatively connected to one end of the intermediate finger follower 138 at a pivot point 142 to horizontally position the intermediate finger follower 138. The valve actuator assembly 110 also includes a second actuator 144 connected to the first actuator 140 to vertically position the first actuator 140. The actuators 140 and 144 are of a linear type such as a solenoid electrically connected to a source of electrical power such, as a controller 145. These actuators 140, 144 are operative as actuators 40, 44 are described with reference to FIGS. 1 and 2. It should also be appreciated that any suitable two degree-of-freedom device, such as a linear slide and rotary pivot or two rotary pivots in series, can be used to position the pivot point 142 in order to obtain a desired lift and phasing of the engine valve 118.

The cam 146 has a cam center 148 that is fixed but rotatable. It should be appreciated that the vertical and horizontal positioning of the pivot point 142 affect phase variation and lift variation of the engine valve 118.

The valve actuator assembly 110 also includes a second roller 139 which is in continuous contact with the intermediate finger follower 138, the roller finger follower 130, and the stationary curved ramp 141. The second roller 139 is biased by the spring 143 toward the intermediate finger follower 138. The curved ramp 141 is fixed to the engine block (or other stationary component) and is operative to guide movement of the roller 141, thereby affecting movement of the roller finger follower 130, and therefore affecting movement of the valve 118.

The engine valve 118 is shown in a closed position in FIG. 4. In operation, the cam 146 pushes against the first roller 137, which causes the intermediate finger follower 138 to swing, and the intermediate finger follower pushes against the second roller 139, which rolls along the ramp 141. When the second roller 139 reaches the curved portion 147 of the stationary ramp 141, it then forces the roller finger follower 130 downward, which then opens the valve 118. The radius of curvature of the curved portion 147 of the ramp 141 must be greater than the radius of the second roller 139.

The actuators 140 and 144 enable the location of the pivot point 142 of the intermediate finger follower 138 to be at any point in the plane of FIG. 4. This allows independent control of lift and phasing of the engine valve 118. It should be appreciated that lift can be varied continuously from zero to a predetermined maximum lift. It should also be appreciated that phasing can also be varied continuously for any cam shaft angle, such as from −15° of cam shaft angle to +15° of cam shaft angle at any lift setting. This type of functionality is considered essential for advanced combustion systems, such as homogeneous charge compression ignition.

The springs 128, 143 maintain the roller 137 in continuous contact with the cam 146, and also maintain the roller 139 in continuous contact with the intermediate finger follower 138, the roller finger follower 130, and the stationary curved ramp 141.

Accordingly, vertical displacement of the pivot point 142 results in either a phase advance or retard, because the lobe of the cam 142 meets the first roller 137 either earlier or later during the course of its rotation, thereby shifting the phase of the valve opening. Valve lift, which is dependent on the extent of oscillation of the intermediate finger follower, is not significantly affected by such vertical displacement of pivot point 142.

Horizontal displacement of the pivot point 142 results in either an increase or decrease of the valve lift, without a change in phasing. If the pivot point 142 is moved to the left, as shown in FIG. 5, then, for a given oscillation of the intermediate finger follower 138, the second roller 139 spends more time on the flat portion (zero lift or lost motion portion, which is the horizontal portion in FIGS. 4 and 5) of the stationary curved ramp 141, than on the curved portion 147 (the opening-closing portion of the ramp). Thus, valve lift is reduced. When the pivot point 142 is moved to the right, for a given oscillation of the intermediate finger follower 138, the roller 139 spends more of its time on the curved portion 147 of the stationary ramp 141, and goes further along the curved portion 147 of the stationary ramp 141, resulting in a larger valve opening. Phasing, which is determined by the point in the driving cam's cycle at which the cam lobe meets the roller 137, is not affected by such horizontal displacement of the pivot point 142.

Turning to FIG. 6, a partial perspective view is shown of an actuator assembly 10 attached to an engine 112 in accordance with the embodiment of FIGS. 4–5. Like reference numerals are used in FIG. 6 to illustrate like components from FIGS. 4 and 5. In particular, FIG. 6 illustrates the relationship between the intermediate finger follower 138, the first roller 137, the second roller 139, the stationary curved ramp 141, and the roller finger follower 130. FIG. 6 also shows the spring 128 which upwardly biases the roller finger follower 130 so that the second roller 139 is constrained between the roller finger follower 130 and the stationary curved ramp 141. The spring 143 of FIGS. 4 and 5 is not shown in FIG. 6, but it biases the second roller 139 against the intermediate finger follower 138 to maintain continuous contact between the moving components. Spring 143 also maintains the continuous contact between the intermediate finger follower 138 and the cam 146. FIG. 6 also shows the relationship of the actuators 140, 144 with respect to the pivot point 142 of the intermediate finger follower 138.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

While the best modes for carrying out the invention have been described in detail, those familiar with the art to which this invention relates will recognize various alternative designs and embodiments for practicing the invention within the scope of the appended claims.

While the best modes for carrying out the invention have been described in detail, those familiar with the art to which this invention relates will recognize various alternative designs and embodiments for practicing the invention within the scope of the appended claims.

The invention claimed is:

1. A valve actuator assembly for an engine of a vehicle comprising:

a movable engine valve;

a movable roller finger follower operatively engaged with said engine valve;

a rotatable cam;

an intermediate finger follower operatively engaged with said roller finger follower and said cam; and at least one actuator operatively cooperating with said intermediate finger follower to position said intermediate finger follower in two directions independent of one another relative to said cam to move said roller finger follower to position said engine valve at a desired, decoupled lift and phasing.

2. A valve actuator assembly as set forth in claim 1 wherein said roller finger follower has one end in contact with one end of said engine valve.

3. A valve actuator assembly as set faith in claim 2 including a hydraulic lash adjuster pivotally connected to the other end of said roller finger follower.

4. A valve actuator assembly as set forth in claim 1 wherein said at least one actuator is pivotally connected to one end of said intermediate finger follower.

5. A valve actuator assembly as set forth in claim 1 wherein said at least one actuator moves said intermediate finger follower in at least one of a horizontal direction and a vertical direction.

6. A valve actuator assembly as set forth in claim 1 wherein said at least one actuator comprises a first actuator pivotally connected to said intermediate finger follower to move said intermediate finger follower in a horizontal direction and a second actuator operatively cooperating with said first actuator to move said first actuator and said intermediate finger follower in a vertical direction.

7. A valve actuator assembly as set forth in claim 1 wherein said at least one actuator comprises a first actuator end a second actuator pivotally connected to said intermediate finger follower to move said intermediate finger follower in a horizontal direction and said first actuator operatively cooperating with said second actuator to move said second actuator and said intermediate finger follower in a vertical direction.

8. A valve actuator assembly as set forth in claim 1 wherein said intermediate finger follower is operatively engaged with said rotatable cam through a first roller, and said intermediate finger follower is operatively engaged with said movable roller finger follower through a second roller to affect movement of the engine valve.

9. A valve actuator assembly as set forth in claim 8 further comprising a stationary ramp which guides movement of said second roller, said ramp having a curved portion to control the vertical displacement of the second roller, thereby controlling valve seating.

10. A valve actuator assembly as set forth in claim 9, wherein said second roller is in continuous rolling contact wit said stationary ramp, said intermediate finger follower, and said movable roller finger follower.

11. A valve actuator assembly as set forth in claim 9, wherein said second roller is spring-biased toward said intermediate finger follower.

12. A valve actuator assembly as set forth in claim 1 wherein said intermediate finger follower pivots about a first pivot point which is connected to said at least one actuator, and said roller finger follower pivots about a second pivot point.

13. A valve actuator assembly as set forth in claim 12 including a controller electrically connected to said at least one actuator to energize and de-energize said at least one actuator.

14. A valve actuator assembly comprising:

a movable engine valve;

a movable roller finger follower operatively engaged with said engine valve;

a rotatable cam;

an intermediate finger follower operatively engaged with said roller finger follower; and a first actuator operatively connected to said intermediate finger follower to move said intermediate finger follower in either one of a horizontal direction and a vertical direction and a second actuator operatively cooperating with said first actuator to move said first actuator and said intermediate finger follower in the other one of a horizontal direction and a vertical direction independent of movement in said one of a horizontal and a vertical direction to position said intermediate finger follower relative to said cam to move said roller finger follower to position said engine valve at a desired, decoupled lift and phasing.

15. A valve actuator assembly as set forth in claim 14 wherein said roller finger follower has one end in contact with one end of said engine valve.

16. A valve actuator assembly as set forth in claim 15 including a lash adjuster pivotally connected to the other end of said roller finger follower.

17. A valve actuator assembly as set forth in claim 14 wherein either one of said first actuator and said second actuator is pivotally connected to one end of said intermediate finger follower.

18. A valve actuator assembly as set forth in claim 14 wherein said first actuator and said second actuator are of a linear type to generate linear motion.

19. A valve actuator assembly as set forth in claim 17 including a controller electrically connected to said first actuator and said second actuator to energize and de-energize said first actuator and said second actuator.

20. A valve actuator assembly as set forth in claim 14 including a housing having a chamber.

21. A valve actuator assembly as set forth in claim 18 including an engine valve spring disposed in said chamber to bias, said engine valve toward a closed position.

22. A valve actuator assembly as set forth in claim 14 wherein said intermediate finger follower is operatively engaged with said rotatable cam through a first roller, and said intermediate finger follower is operatively engaged with said movable roller finger follower through a second roller to affect movement of the engine valve.

23. A valve actuator assembly as set forth in claim 22 further comprising a stationary ramp which guides movement of said second roller, said ramp having a curved portion to control the vertical displacement of the second roller, thereby controlling valve seating.

24. A valve actuator assembly as set forth in claim 23, wherein said second roller is in continuous rolling contact with said stationary ramp, said intermediate finger follower, and said movable roller finger follower.

25. A valve actuator assembly as set forth in claim 24, wherein said second roller is spring-biased toward said intermediate finger follower.

26. A valve actuator assembly as set forth in claim 23, wherein said stationary ramp is mounted to an engine block.

27. A method of operating a valve actuator assembly for a vehicle comprising:

providing a movable engine valve;

providing a movable roller finger follower operatively engaged with the engine valve;

providing a cam and rotating the cam;

providing an intermediate finger follower operatively engaged with the roller finger follower; and actuating at least one actuator operatively cooperating with the intermediate finger follower in vertical and horizontal directions independent of one another, positioning the intermediate finger follower relative to the cam, and positioning the engine valve at a desired, decoupled lift and phasing.

28. A valve actuator assembly for an engine of a vehicle comprising:

a movable engine valve;

a movable roller finger follower operatively engaged with said engine valve;

a rotatable cam;

an intermediate finger follower operatively engaged with said cam through a first roller, and operatively engaged with said roller finger follower trough a second roller, said second roller being guided by a stationary curved ramp; and at least one actuator operatively cooperating with said intermediate finger follower to position said intermediate finger follower in two directions relative to said cam to move said roller finger follower to position said engine valve at a desired lift and phasing.

* * * * *

UNITED STATES PATENT AND TRADEMARK OFFICE

CERTIFICATE OF CORRECTION

PATENT NO. : 7,007,649 B2
APPLICATION NO. : 10/771279
DATED : March 7, 2005
INVENTOR(S) : Madhusudan Raghavan and Jie Tong It is certified that error appears in the above-identified patent and that said Letters Patent is hereby corrected as shown below:

In column 4, line 62: replace "($lift_{REF}$)" with --($lift_{RFF}$)-- and
Replace "(□)" with --(θ)--.

In column 5, line 17: replace "□x" with --δx--.

Signed and Sealed this

Thirtieth Day of January, 2007

JON W. DUDAS
*Director of the United States Patent and Trademark Office*

UNITED STATES PATENT AND TRADEMARK OFFICE

CERTIFICATE OF CORRECTION

PATENT NO. : 7,007,649 B2
APPLICATION NO. : 10/771279
DATED : March 7, 2006
INVENTOR(S) : Madhusudan Raghavan and Jie Tong It is certified that error appears in the above-identified patent and that said Letters Patent is hereby corrected as shown below:

In column 4, line 62: replace "($lift_{REF}$)" with --($lift_{RFF}$)-- and
Replace "(□)" with --(θ)--.

In column 5, line 17: replace "□x" with --δx--.

This certificate supersedes Certificate of Correction issued January 30, 2007.

Signed and Sealed this

Sixth Day of March, 2007

JON W. DUDAS
*Director of the United States Patent and Trademark Office*